US008539907B2

(12) United States Patent
Hsu et al.

(10) Patent No.: US 8,539,907 B2
(45) Date of Patent: Sep. 24, 2013

(54) APPARATUS FOR CHEMICAL BATH DEPOSITION BETWEEN TWO COVERS, WHEREIN A COVER IS A SUBSTRATE

(75) Inventors: Wei-Tse Hsu, Taoyuan County (TW); Chung-Wen Lan, New Taipei (TW); Yi-Song Luo, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 241 days.

(21) Appl. No.: 13/090,219

(22) Filed: Apr. 19, 2011

(65) Prior Publication Data

US 2012/0132134 A1 May 31, 2012

(30) Foreign Application Priority Data

Nov. 30, 2010 (TW) ..... 99141425 A

(51) Int. Cl.

| | |
|---|---|
| ***B05C 3/00*** | (2006.01) |
| ***B05C 19/02*** | (2006.01) |
| *B05D 1/18* | (2006.01) |
| *C25D 1/12* | (2006.01) |
| *C25D 13/00* | (2006.01) |

(52) U.S. Cl.
USPC ..... 118/429; 118/400; 118/423; 118/427; 118/DIG. 9; 427/434.3; 427/434.4; 204/476; 204/622

(58) Field of Classification Search
USPC ..... 118/DIG. 12, DIG. 19, 400, 407, 118/429, 64, 427, 423, DIG. 9; 427/97, 9, 427/430.1, 434.4; 204/622
See application file for complete search history.

(56) References Cited

U.S. PATENT DOCUMENTS

| | | | | |
|---|---|---|---|---|
| 1,427,877 | A * | 9/1922 | Weeks | 205/671 |
| 4,007,097 | A * | 2/1977 | Noz | 205/128 |
| 4,307,128 | A * | 12/1981 | Nagano et al. | 427/601 |
| 4,418,641 | A * | 12/1983 | Nakashima et al. | 118/429 |
| 4,750,977 | A * | 6/1988 | Marrese | 205/148 |
| 4,755,273 | A * | 7/1988 | Bassett et al. | 204/622 |
| 5,052,812 | A * | 10/1991 | Tannenbaum et al. | 366/209 |
| 5,451,429 | A * | 9/1995 | Chapman | 427/250 |
| 5,681,391 | A * | 10/1997 | Mistrater et al. | 118/400 |
| 5,725,667 | A * | 3/1998 | Petropoulos et al. | 118/407 |
| 5,827,410 | A * | 10/1998 | Hosten | 204/198 |
| 5,830,805 | A * | 11/1998 | Shacham-Diamand et al. | 438/678 |
| 6,010,572 | A * | 1/2000 | Furusawa et al. | 118/408 |
| 6,153,064 | A * | 11/2000 | Condra et al. | 204/198 |
| 6,165,330 | A * | 12/2000 | Ohba | 204/198 |
| 6,217,735 | B1 * | 4/2001 | Reynolds | 205/137 |
| 6,506,260 | B1 * | 1/2003 | Hiraishi et al. | 134/15 |

(Continued)

OTHER PUBLICATIONS

Jun Young Choi et al., "Properties of Cadmium Sulfide Thin Films Deposited by Chemical Bath Deposition with Ultrasonication," Solar Energy, Mar. 1998, vol. 64, Nos. 1-3, pp. 41-47, Elsevier Science Ltd. UK.

(Continued)

*Primary Examiner* — Dah-Wei Yuan
*Assistant Examiner* — Karl Kurple

(57) ABSTRACT

The invention provides a film deposition apparatus, which includes a first cover and a second cover, wherein the first cover and the second cover are disposed opposite to each other, and the first cover has at least two holes, and a spacer disposed between the first cover and the second cover, wherein the first cover, the spacer and the second cover form a film deposition space.

15 Claims, 4 Drawing Sheets

(56) References Cited

U.S. PATENT DOCUMENTS

| | | | | |
|---|---|---|---|---|
| 6,530,385 | B2 * | 3/2003 | Meuris et al. | 134/25.4 |
| 6,712,081 | B1 * | 3/2004 | Uehara et al. | 134/105 |
| 6,799,588 | B1 * | 10/2004 | Speh et al. | 134/64 R |
| 6,852,166 | B2 * | 2/2005 | Kinoshita et al. | 118/423 |
| 6,890,416 | B1 * | 5/2005 | Mayer et al. | 205/261 |
| 6,962,626 | B1 * | 11/2005 | Bush et al. | 118/423 |
| 7,022,451 | B2 * | 4/2006 | Kinoshita | 430/127 |
| 7,204,918 | B2 * | 4/2007 | Glassman | 204/242 |
| 7,288,349 | B2 * | 10/2007 | Kinoshita et al. | 430/56 |
| 7,541,067 | B2 | 6/2009 | Basol | |
| 7,585,547 | B2 | 9/2009 | Basol et al. | |
| 7,645,491 | B2 * | 1/2010 | Bush et al. | 427/430.1 |
| 2002/0020628 | A1 * | 2/2002 | Basol | 205/102 |
| 2003/0138565 | A1 * | 7/2003 | Lewis | 427/372.2 |
| 2003/0150738 | A1 * | 8/2003 | Glassman | 205/125 |
| 2004/0052963 | A1 * | 3/2004 | Ivanov et al. | 427/443.1 |
| 2006/0193992 | A1 * | 8/2006 | Bonkass et al. | 427/430.1 |
| 2007/0117365 | A1 * | 5/2007 | Kuriyama et al. | 438/597 |
| 2007/0190240 | A1 * | 8/2007 | Choi et al. | 427/123 |
| 2009/0283031 | A1 * | 11/2009 | Grasso | 118/104 |
| 2010/0068404 | A1 * | 3/2010 | Wang et al. | 427/430.1 |
| 2011/0011335 | A1 * | 1/2011 | Thie et al. | 118/58 |
| 2011/0308455 | A1 * | 12/2011 | Choi et al. | 118/708 |
| 2011/0318493 | A1 * | 12/2011 | Wu et al. | 427/314 |
| 2012/0312229 | A1 * | 12/2012 | Pei | 118/56 |

OTHER PUBLICATIONS

S. Eitssayeam et al., "Properties of CdS:Ni Films Prepared by Chemical Bath Deposition Method," Journal of Materials Science, 2005, pp. 3803-3807, Springer Science + Business Media, Inc. US.

Akira Ichiboshi et al., "Ultrasonic Chemical Bath Deposition of ZnS(O,OH) Buffer Layers and its Application to CIGS Thin-Film Solar Cells," Solar Energy Materials & Solar Cells, Nov. 2006, pp. 3130-3135, vol. 90, Issues 18-19, Elsevier B.V. US.

K. Kushiya et al., "Yield Issues on teh Fabrication of 30cmx30cm-sized Cu(In,Ga)$Se_2$-Based Thin-Film Modules," Solar Energy Materials & Solar Cells, 2003, pp. 171-178, Elsevier, US.

Katsumi Kushiya, et al., "Application of Zn-Compound Buffer Layer for Polycrystalline $CuInSe_2$-Based Thin-Film Solar Cells," Japanese Journal of Applies Physics, Aug. 1996, vol. 35, pp. 4383-4388, Tha Japan Society of Applied Physics, Japan.

Takuya Nakanishi et al., "Properties of Chemical Bath Deposited CdS Thin Films," Solar Energy Materials and Solar Cells, Sep. 1994, pp. 171-178, vol. 35, Elsevier, US.

* cited by examiner

APPARATUS FOR CHEMICAL BATH DEPOSITION BETWEEN TWO COVERS, WHEREIN A COVER IS A SUBSTRATE

CROSS REFERENCE TO RELATED APPLICATIONS

This application claims priority of Taiwan Patent Application No. 099141425, filed on Nov. 30, 2010, the entirety of which is incorporated by reference herein.

BACKGROUND OF THE INVENTION

1. Field of the Invention

The present invention relates to an apparatus for film deposition, and in particular relates to an apparatus for chemical bath deposition.

2. Description of the Related Art

Development in the solar cell industry is driven by global environmental concerns and rising raw material prices. Among the various solar cells developed, dye-sensitized solar cell (DSSC) is advantageous as it can be fabricated with relatively lower costs due to its simpler fabrication process and ability for large area fabrication.

In a solar cell, a buffer layer plays an important role, because it is used as an n-type material and it protects the absorption layer of the solar cell. Therefore, it is important to fabricate a high quality buffer layer to improve the photoelectric conversion efficiency of solar cells.

Techniques for deposition of the buffer layer include: sputtering, vacuum evaporation, chemical bath deposition (CBD), spray pyrolysis, in which chemical bath deposition (CBD), is a widely used method due to its simple process and required low cost equipment. However, the conventional CBD process consumes a large amount of chemicals, and results in a large amount of waste.

FIG. 1 shows a conventional chemical bath deposition (CBD) apparatus which comprises a crucible 11, top cover 12 and a plurality of substrates 13 for film deposition. Because the substrates 13 are vertically disposed in the crucible 11, the upper portion and the lower portion of the substrate 13 have a non-uniform film thickness. Additionally, a large amount of solution for film deposition is needed, and after the deposition process, washing of the crucible 11 is needed.

Thus, there is a need to provide a chemical bath bat-deposition apparatus with a simple process, using fewer chemicals.

BRIEF SUMMARY OF THE INVENTION

The invention provides an apparatus for chemical bath deposition, comprising: a first cover and a second cover, wherein the first cover and the second cover are disposed opposite to each other, and the first cover has at least two holes; and a spacer disposed between the first cover and the second cover, wherein the first cover, the spacer and the second cover form a film deposition space.

A detailed description is given in the following embodiments with reference to the accompanying drawings.

BRIEF DESCRIPTION OF THE DRAWING

For a more complete understanding of the present invention, and the advantages thereof, reference is now made to the following descriptions taken in conjunction with the accompanying drawings, in which.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
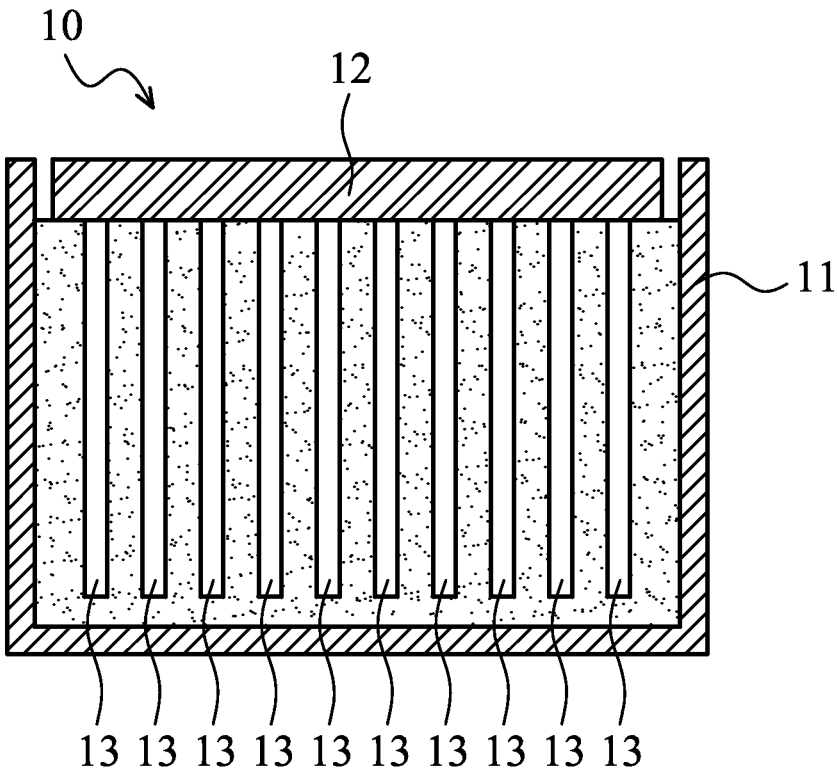
FIG. 1 ( PRIOR ART )
FIG. 1 shows a cross-sectional representation of an apparatus for chemical bath deposition (CBD) in accordance with an conventional technique.
Figure 2:
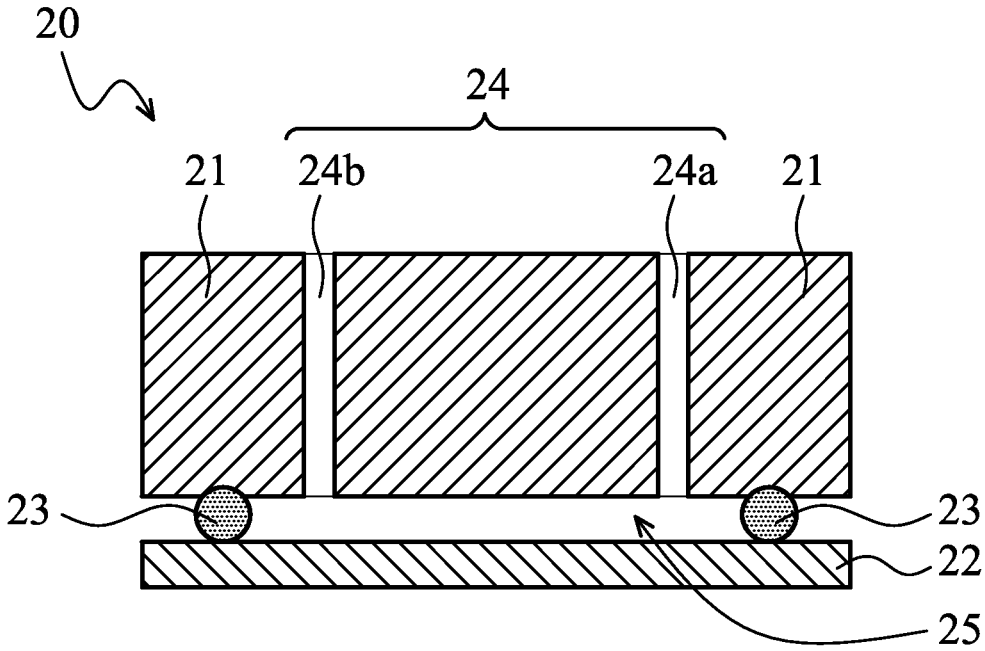
FIGS. 2 and 3 show a series of cross-sectional schematic representations of an apparatus for chemical bath deposition (CBD) in accordance with an embodiment of the invention.

Referring to FIG. 2, the invention provides an apparatus for chemical bath deposition (CBD) which comprises a first cover 21, a second cover 22 and a spacer 23, wherein the first cover 21 and the second cover 22 are disposed opposite to each other, and the first cover 21, the second cover 22 and the spacer 23 forms a film deposition space 25.

In order to improve the seal-tightness between the first cover 21 and the second cover 22, the edge of first cover 21 or the second cover 22 has a groove (not shown in FIG. 2). The spacer 23 may be embedded in the groove of the first cover 21 or the second cover 22. As a result, a solution (e.g. a solution for film deposition) is sealed in the film deposition space 25 formed by the first cover 21, the second cover 22 and the spacer 23. Thus, the solution leaking problem may be improved by the help of the groove. The groove comprises a circular, rectangular or irregular shape. The shape of the groove is not limited to the above-mentioned shape, and those skilled in the art may adjust the shape according to actual application needs.

The function of the first cover 21 is to reduce the evaporation loss of the solution. The first cover 21 has at least two holes 24, and one hole 24*a* is used as a solution inlet, and the other hole 24*b* is used as a solution outlet. When the solution is prepared to be filled into the solution inlet 24*a*, the solution outlet 24*b* is opened to balance the pressure in the film deposition space 25 to help the injection of solution. The holes have a diameter of about 3-5 mm. Note that the diameter may not be too large in order to avoid evaporation of the solution and degradation of film quality.

The first cover 21 has good corrosion resistance, and acid/base resistance, and is made of material such as aluminum alloy, glass, quartz, aluminum oxide or polymer, wherein the polymer comprises polyvinyl chloride (PVC), polytetrafluoroethylene (PTFE) or polypropylene (PP). In one embodiment, the material of the first cover 21 is preferred to be polytetrafluoroethylene (PTFE). Because PTFE has low surface energy, a film would not likely form on the PTFE following the deposition process. Thus, after the deposition process, the first cover 21 made of PTFE, would be easy to wash.

Additionally, the first cover 21 also provides a pressure to the second cover 22, and the pressure prevents the solution from leaking out therefrom, to improve the seal-tightness of the first cover 21 and the second cover 22. The spacer 23 is used to seal the first cover 21 and the second cover 22, and thus the seal-tightness of the spacer 23 my also be improved by the pressure which is provided by the first cover 21.

The second cover 22 may be a substrate for film deposition, and the material of the second cover comprises glass, stainless steel or polyimide (PI). Moreover, a substrate for film deposition may be disposed on the inner surface of the first cover 21, while the second cover 22 is another substrate for film deposition, wherein the two substrates for film deposition may be disposed simultaneously. Note that the substrate for film deposition may be the second cover or further be disposed on the inner surface of the first cover, and those skilled in the art may adjust the arrangement of the substrate according to actual application needs.

The function of the spacer 23 is to seal the first cover 21 and the second cover 22, and the spacer 23 has good elastic property, good acid/base resistance, and low surface energy. The material of the spacer 23 comprises rubber, silicone or polytetrafluoroethylene (PTFE). In one embodiment, an O-ring with a diameter of about 60 mm-200 mm and a thickness of about 2 mm-15 mm is used as the spacer 23.

Note that the height of the solution for film deposition filled in the film deposition space 25 is determined by the height of the spacer 23. In general, the height of the spacer 23 is about 2 mm-10 mm. Thus, waste is reduced due to the reduced heights.

Figure 3:
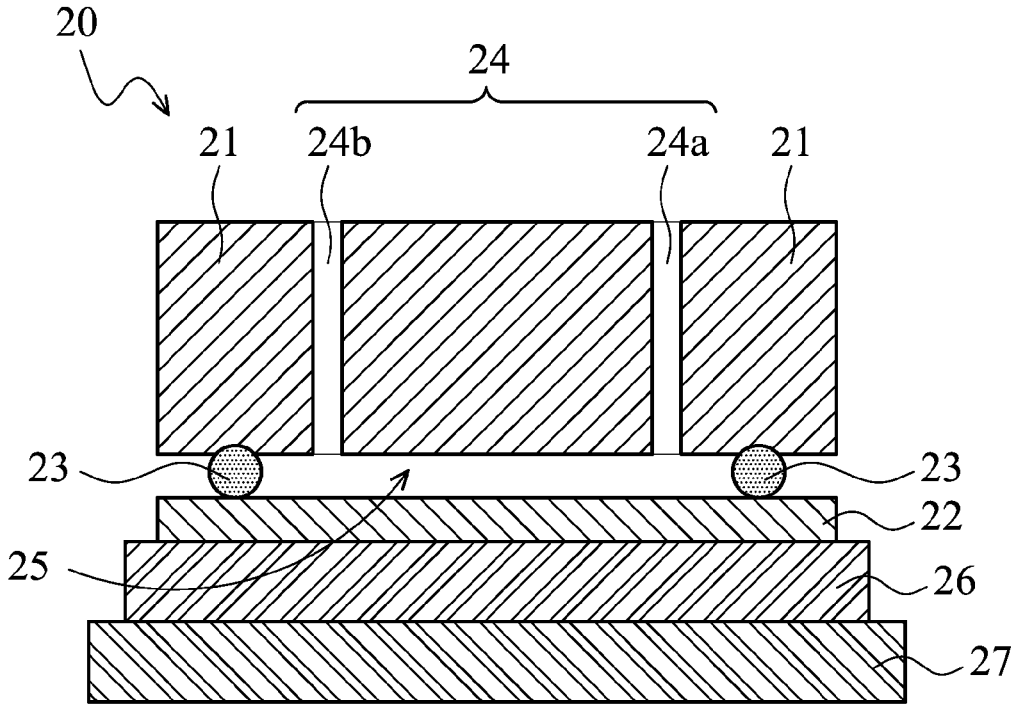

Referring to FIG. 3, the invention provides an apparatus for chemical bath deposition (CBD) which further comprises a heater 26 disposed below the second cover 22. In another embodiment, while a substrate for film deposition is disposed on the inner surface of the first cover 21, the heater 26 may be disposed on the first cover 21. The function of the heater 26 is to provide the high temperature environment needed for the film deposition. The heater 26 may be a conventional heater or a heat storage material. For example, a material (such as stainless steel or copper block) with high thermal conductivity is soaked into hot water, and then the material is taken out from the heated water to be used as a heat storage material.

Note that because the second cover 22 itself is a substrate for film deposition and the heater 26 is directly disposed below the second cover 22, the substrate for film deposition is heated directly. In the conventional techniques, the solution rather than the substrate is heated. Thus, the advantages of the apparatus of the invention are to save energy and reduce film deposition time.

The apparatus of the invention further comprises a magnetic material in the first cover 21. When the second cover 22 is disposed on the heater 26, the magnetic material of the first cover 21 may be attracted by the heater 26 (made of magnetic material) to provide an additional pressure. The additional pressure may improve the seal-tightness between the first cover 21 and the second cover 22 and prevent the solution from leaking.

Furthermore, referring to FIG. 3, the invention provides an apparatus for chemical bath deposition (CBD) which further comprises a shaking device 27 disposed below the heater 26. In another embodiment, the shaking device 27 may be directly disposed below the second cover 22. In yet another embodiment, a shaking device incorporating a heating mechanism is disposed below the second cover 22. The shaking device 27 may be shaken by forward spinning, reverse spinning, shaking, rotation or revolution to obtain a uniform film.

Figure 4:
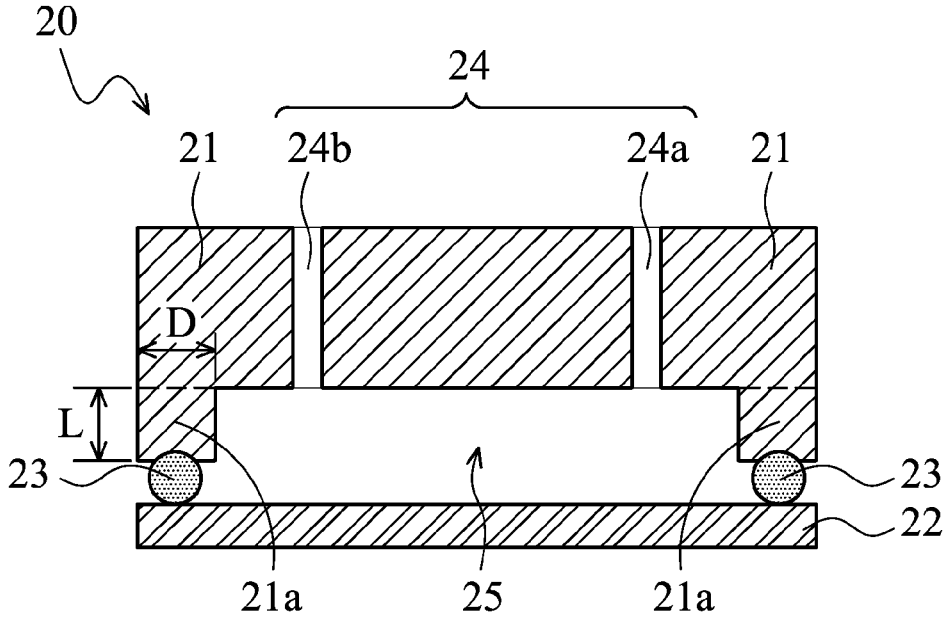
FIG. 4 shows a cross-sectional schematic representation of an apparatus for chemical bath deposition (CBD) in accordance with another embodiment of the invention.

Referring to FIG. 4, the invention also provides a second embodiment. The difference between the FIG. 4 and FIG. 2 is that the first cover 21 has an outer edge, and the outer edge has an extension portion 21*a*, and the extension portion 21*a* contacts the spacer 23 in FIG. 4. The extension portion 21*a* has a length L and a width D. The length L may be adjusted to a desired height according to the solution needed. The width D may be adjusted according to the size of the spacer 23 needed. If a small sized spacer 23 is provided, a small contact area between the spacer 23 and the first cover 21/second cover 22 will be obtained. Thus, the seal-tightness between the first cover 21 and the second cover 22 may further be improved by reducing the contact area.

In the film deposition process, the solution is injected from the hole 24, and a desired thickness of film is obtained by controlling the time and temperature of the film deposition process. After the deposition process, a washing process is conducted by injecting air, argon, nitrogen or de-ionized water from the inlet 24*a* into the space 25 to wash the first cover 21 and the second cover 22. The waste solution is then exhausted from the outlet 24*b*. The simple washing process is provided to reduce cost.

Additionally, before conducting the above-mentioned film deposition process, the surface composition or the surface morphology of the substrate may be changed by a specific compound. For example, before fabricating the buffer layer of CIGS cell, the substrate is etched by the bromine water to change the surface morphology thereof, or the substrate is dipped into a potassium cyanate (KCN) solution to change the surface composition thereof. Thus, the toxic bromine water and the toxic potassium cyanate (KCN) solution are limited in the small sized film deposition space 25 by the apparatus of the invention. Thus, the use of the toxic material is reduced.

In prior art, a crucible is often used as a solution container, and the film is not only grown on a substrate but also on the crucible. Thus, the crucible is needed to be washed after every cycle of the film deposition process. Note that the invention provides an apparatus formed by the first cover, the second cover and the spacer without the crucible, and the film is only grown on the substrate for film deposition (such as the second cover). Thus, the utilization rate of the solution is improved, and the use of the solution is reduced and no additional washing crucible process is needed.

Therefore, the apparatus for CBD of the invention has several advantages as follows.

(1) By the design of the first cover, the second cover and the spacer, the utilization degree of the solution is improved, the use of the solution is reduced and waste is reduced.

(2) The substrate for film deposition is heated directly to save energy and reduce film deposition time.

(3) The first cover or the second cover is used as a container rather than the crucible to simplify the washing process and reduce time and cost.

【EXAMPLE】

Example 1

0.00185 M of cadmium sulfate ($CdSO_4$), 1.5 M of ammonia ($NH_4OH$) and 0.075 M of thiourea ($(NH_2)_2CS$) were mixed together to prepare a solution for film deposition.

The apparatus 20 is shown in FIG. 3, and the second cover 22 had an area of about 50 $cm^2$, the spacer 23 had a diameter of about 80 mm, the spacer 23 had a thickness of about 6 mm and the height of the solution was about 3 mm.

The film deposition process is described as follows:

(1) a second cover (glass substrate) 22 was disposed on a heater 26;

(2) a spacer 23 and the first cover 21 (made of PTFE) were disposed on the second cover 22;

(3) a solution for film deposition was injected from a hole 24 into a film deposition space 25;

(4) the solution was heated at 70° C. for 20 minutes to obtain a cadmium sulfide (CdS) film with a thickness of 80 mm, or at 70° C. for 40 minutes to obtain a cadmium sulfide (CdS) film with a thickness of 100 mm; and (5) After the film deposition process, a washing process was conducted, and de-ionized water was injected into the space 25 through an inlet 24*a* and was exhausted through outlet 24*b* to wash the apparatus 20.

Example 2

Example 2 is similar with Example 1, with the difference being that a shaking device (YSC. Company) 27 was added in Example 2.

Figure 5A:
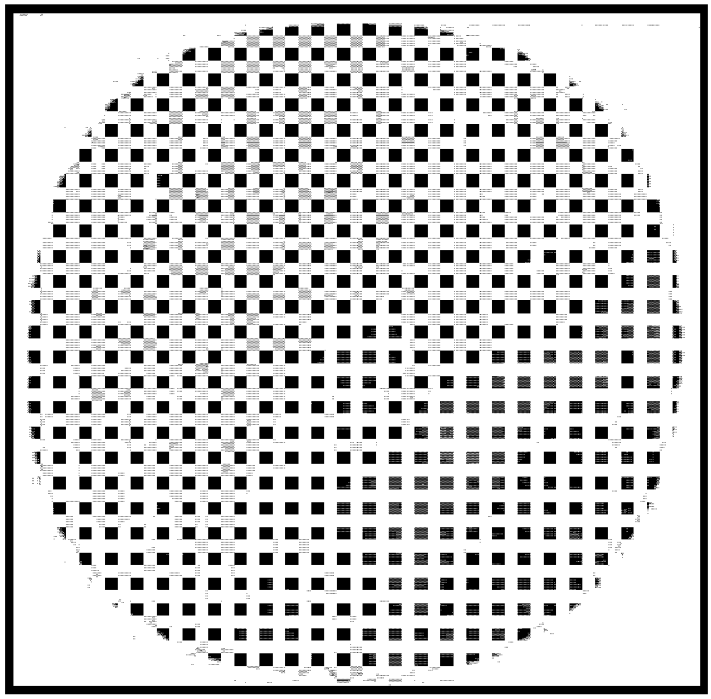
FIGS. 5A-5B show surface morphology representations of deposition film in accordance with an embodiment of the invention.
Figure 5B:
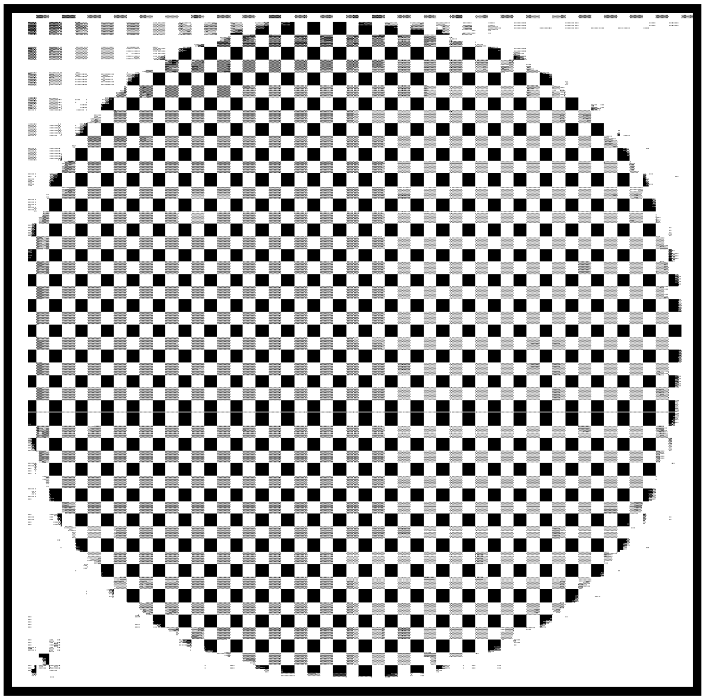
Figure 5C:
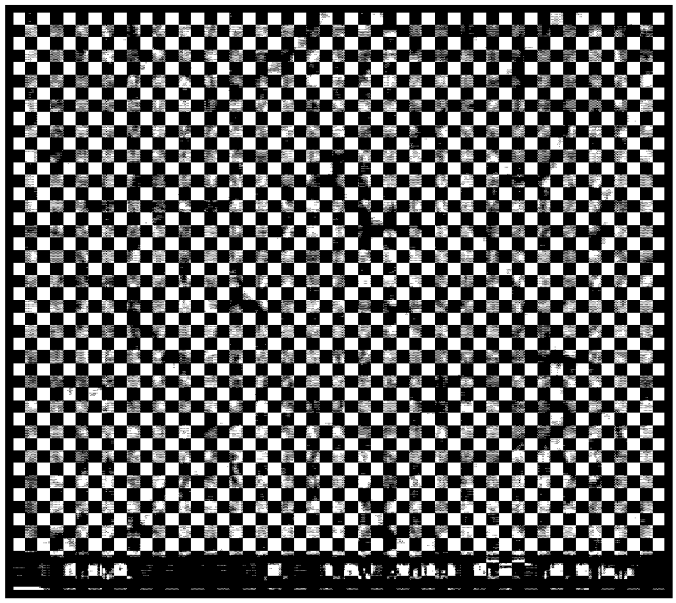
FIGS. 5C-5D show a microscopic representation of deposition film in accordance with an embodiment of the invention.
Figure 5D:
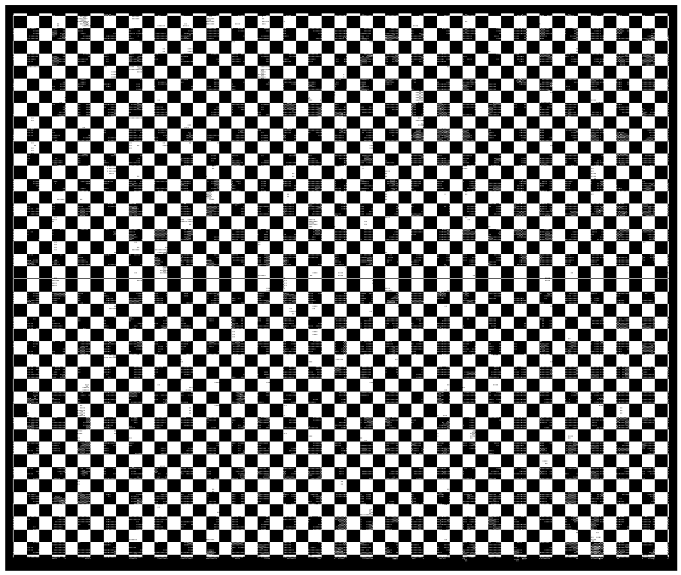

FIGS. 5A-5B show the surface morphology representations of the deposition film under the condition at 70° C. for 30 minutes. Compared with FIG. 5A (Example 1), FIG. 5B (Example 2) shows a more uniform film. FIGS. 5C-5D respectively show the microscopic representations of the deposition film of FIG. 5A-5B (×100 times). As shown in FIG. 5C, some holes appeared in the film of Example 1. Compared with FIG. 5C, FIG. 5D (Example 2) shows a smooth film. Thus, the quality of the film was improved by incorporating the shaking device with the apparatus of the invention.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An apparatus for chemical bath deposition, comprising:

a first cover and a second cover, wherein the first cover and the second cover are disposed opposite to each other, the second cover is a substrate for film deposition using a solution, and the first cover has at least two holes;

a spacer disposed between the first cover and the second cover, wherein the first cover, the spacer and the second cover together form a film deposition space for containing the solution, arranged such that the second cover is horizontally disposed during the film deposition and removable from the first cover subsequent to the film deposition; and a heater, wherein the second cover is disposed on the heater.

2. The apparatus for chemical bath deposition as claimed in claim 1, further comprising a shaking device disposed below the heater.

3. The apparatus for chemical bath deposition as claimed in claim 1, further comprising a shaking device disposed below the second cover.

4. The apparatus for chemical bath deposition as claimed in claim 1, wherein the edge of first cover or the second cover has a groove, and the spacer is disposed in the groove.

5. The apparatus for chemical bath deposition as claimed in claim 1, wherein the material of the first cover comprises aluminum alloy, glass, quartz, aluminum oxide or polymer.

6. The apparatus for chemical bath deposition as claimed in claim 5, wherein the polymer comprises polyvinyl chloride (PVC), polytetrafluoroethylene (PTFE) or polypropylene (PP).

7. The apparatus for chemical bath deposition as claimed in claim 4, wherein the groove comprises a circular or rectangular shape.

8. The apparatus for chemical bath deposition as claimed in claim 1, further comprising a magnetic material in the first cover.

9. The apparatus for chemical bath deposition as claimed in claim 1, wherein the material of the spacer comprises rubber, silicone or polytetrafluoroethylene (PTFE).

10. The apparatus for chemical bath deposition as claimed in claim 1, wherein the material of the second cover comprises glass, stainless steel or polyimide (PI).

11. The apparatus for chemical bath deposition as claimed in claim 1, wherein the first cover has an outer edge, and the outer edge has an extension portion, and the extension portion contacts the spacer.

12. The apparatus for chemical bath deposition as claimed in claim 1, wherein the at least two holes comprise a first hole arranged to receive a solution for film deposition and a second hole arranged to output the solution.

13. The apparatus for chemical bath deposition as claimed in claim 1, arranged such that the spacer is a sidewall of the film deposition space.

14. The apparatus for chemical bath deposition as claimed in claim 1, wherein the second cover forms the bottom wall of the film deposition space.

15. The apparatus for chemical bath deposition as claimed in claim 1, wherein another substrate for film deposition is disposed on an inner surface of the first cover.

* * * * *